US009597785B1

(12) United States Patent
Gertner

(10) Patent No.: US 9,597,785 B1
(45) Date of Patent: Mar. 21, 2017

(54) DEPTH SETTER WITH A TRUNCATED DISTAL EDGE PORTION

(71) Applicant: Starborn Industries, Inc., Edison, NJ (US)

(72) Inventor: Steven D. Gertner, Brooklyn, NY (US)

(73) Assignee: Starborn Industries, Inc., Edison, NJ (US)

( * ) Notice: Subject to any disclaimer, the term of this patent is extended or adjusted under 35 U.S.C. 154(b) by 275 days.

(21) Appl. No.: 14/514,496

(22) Filed: Oct. 15, 2014

Related U.S. Application Data

(60) Provisional application No. 61/961,963, filed on Oct. 28, 2013.

(51) Int. Cl.
*B25B 23/00* (2006.01)
*B25B 15/00* (2006.01)

(52) U.S. Cl.
CPC ..... *B25B 23/0064* (2013.01); *B25B 15/00* (2013.01); *B25B 23/0007* (2013.01)

(58) Field of Classification Search
CPC ..... B25B 23/0064; B25B 23/005; B25B 23/0007; B25B 21/007; B25B 15/00
See application file for complete search history.

(56) References Cited

U.S. PATENT DOCUMENTS 4,140,161 A * 2/1979 Russo ..... B25B 23/10 81/451
4,287,923 A 9/1981 Hornung
5,101,698 A * 4/1992 Paradiso ..... B25B 23/14 81/180.1
5,182,973 A * 2/1993 Martindell ..... B25B 23/12 81/429
5,795,110 A * 8/1998 Wirth, Jr. et al. .... B23B 49/005 408/110
7,258,513 B2 8/2007 Gertner
8,302,513 B2 * 11/2012 Evatt ..... B25B 15/001 81/177.2
8,733,216 B1 * 5/2014 Cantlon ..... B25B 23/12 81/429
2009/0049961 A1 * 2/2009 Chen ..... B25B 15/001 81/429
2012/0006160 A1 * 1/2012 Wang ..... B25B 15/001 81/438

OTHER PUBLICATIONS

Magnetic Adjustable Screw Depth Setter Model DW2043 (DeWalt Industrial Tool Co., Baltimaore, MD), online product catalog http://www.dewalt.com/tool-parts/fastening-accessories-screwdriving-screwdepth-setter-dw2043.aspx.
Magnetic Adjustable Screw Depth Setter Model DW2043 (DeWalt Industrial Tool Co., Baltimaore, MD), product photo.
Depth Driver Model No. 2421 by Wolfcraft GmbH, Kempenich, Germany (as surrogate for Wolfcraft Model No. 2420 cited in instant application).

* cited by examiner

*Primary Examiner* — David B Thomas
(74) *Attorney, Agent, or Firm* — Irving M Fishman

(57) ABSTRACT

A depth setter for a rotary tool, includes a distal end having a centrally-located bit tip and a cylindrical collar with an edge portion extending therearound, where the edge portion includes a resilient elastomeric material extending therealong and a truncated surface extending peripherally therearound, and an attachment end for securely attaching the depth setter to the drive mechanism of the rotary tool.

5 Claims, 3 Drawing Sheets

DEPTH SETTER WITH A TRUNCATED DISTAL EDGE PORTION

CROSS-REFERENCE TO RELATED APPLICATIONS

This application claims priority of U.S. Provisional Application Ser. No. 61/961,963, filed Oct. 28, 2013.

STATEMENT REGARDING FEDERALLY SPONSORED RESEARCH OR DEVELOPMENT

Not Applicable

FIELD OF THE INVENTION

The present invention relates to power tool accessories, and more particularly to a depth setter with a truncated distal edge portion for use with power tools, in which the depth setter can be optionally fixed to a set depth or optionally can be adjustable in its depth setting.

BACKGROUND OF THE INVENTION

Depth setters are well known and widely marketed for at least the past 20 years. Such devices are typically attached to the working end of a power tool such as a hand-held power drill for drilling holes and driving screws. In the latter role, the depth setter includes a distal end having a centrally located screw bit tip which fits onto the head of a screw and a cylindrical collar with an edge portion extending therearound, and an attachment end which attaches to the drive mechanism of the power tool. During driving of the screw into a workpiece, the cylindrical collar acts as a stop when the edge portion contacts the surface of the workpiece at a predetermined depth.

The depth setter may include a clutch mechanism for interrupting transmission of torque to the screw upon reaching a predetermined depth of screw penetration to prevent damage to the screw and the workpiece. During operation, the screw bit tip engages the screw until the cylindrical collar contacts the surface of the workpiece. Once contact is made, the clutch mechanism disengages the screw bit tip from the screw. An example of a depth setter is shown and disclosed in U.S. Pat. No. 4,287,923 issued to Homung.

The depth setter may further include an adjustment feature which allows the user to vary the depth of the screw. An example of an adjustable depth setter is the Hex Shank Non-Magnetic Adjustable Screw Depth Setter Model No. DW2043 marketed by DeWalt Industrial Tool Co. of Baltimore, Md. The depth setter may also include a freed spinning collar to minimize the possibility of the edge portion of the collar marring the workpiece surface. An example of a depth setter with this type of collar is the Depth Driver 1 Model No. 2420 marketed by Wolfcraft GmbH of Kempenich, Germany.

Although a free spinning collar minimizes marring, surface damage can still occur in some materials and under certain conditions. In some instances, the spinning collar can burnish the surface before it completely stops rotating due to inertia. This can occur most often in dense hardwoods with smoothly sanded surfaces, and in softer materials such as PVC trim boards. This problem is particularly acute when the angle of the depth setter is less than normal to the workpiece surface (i.e., less than 90°). Collars in prior art depth setters are generally configured with sharp 90° edges that can cut into or easily dent the surface of workpieces particularly softer materials before engagement of the clutch mechanism.

Accordingly, there is a need for a depth setter for use with rotary-type power tools, configured for minimizing marring or other damage to the surface of a workpiece. Furthermore, there is a need for a depth setter that is simple and cost efficient to make and use. Finally, there is a need for such depth setters with fixed as well as with adjustable depth settings.

SUMMARY OF THE INVENTION

The present invention relates generally to a depth setter for use with rotary power tools, configured for minimizing marring or other damage to the surface of a workpiece. The depth setter of the present invention facilitates precision depth setting for driving of screw and/or drilling holes, for example, while preserving the surface of a workpiece. In particular, the depth setter of the present invention is designed to prevent or at least substantially reduce the incidence of marring or other damage to the workpiece. The depth setter of the present invention includes a collar comprising a shell having an open end and a workpiece engaging portion extending along the open end thereof for contacting the workpiece. The depth setter of the present invention can be configured with either a fixed depth setting or an adjustable depth setting. The depth setter of the present invention is simple and cost efficient to make and use.

In one aspect of the present invention, there is provided a depth setter for a rotary tool, which includes:

- a distal end having a centrally-located bit tip and a cylindrical collar with an edge portion extending therearound;
- said edge portion includes a resilient elastomeric material extending therealong and a truncated surface extending peripherally therearound; and
- an attachment end for securely attaching the device to the drive mechanism of a rotary tool.

BRIEF DESCRIPTION OF THE DRAWING

The following drawings are illustrative of embodiments of the present invention and are not intended to limit the invention as encompassed by the claims forming a part of the application.

DETAILED DESCRIPTION OF THE INVENTION

The present invention is directed generally to a depth setter for use with rotary tools, configured for minimizing marring or other damage to the surface of a workpiece. The depth setter of the present invention facilitates precision depth setting for driving screws and/or drilling holes, for example, while preserving the surface of the workpiece. In particular, the depth setter of the present invention is designed to prevent or at least substantially reduce the incidence of marring or other damage to the workpiece. The depth setter of the present invention includes a collar comprising a shell having an open end and a workpiece engaging portion extending along the open end thereof for contacting the workpiece. The depth setter of the present invention is simple and cost efficient to make and use.

In some embodiments of the present invention, the depth limiting device is adjustable to depth settings selected by the user. In other embodiments of the present invention, the depth limiting device has a fixed depth limit.

In one embodiment of the present invention, the depth limiting device comprises a distal end having a centrally-located bit tip and a cylindrical collar with an edge portion extending therearound, where the edge portion includes a resilient elastomeric material extending therealong and a truncated surface extending peripherally therearound, and an attachment end for securely attaching the depth setter to the drive mechanism of the rotary tool.

Figure 1:
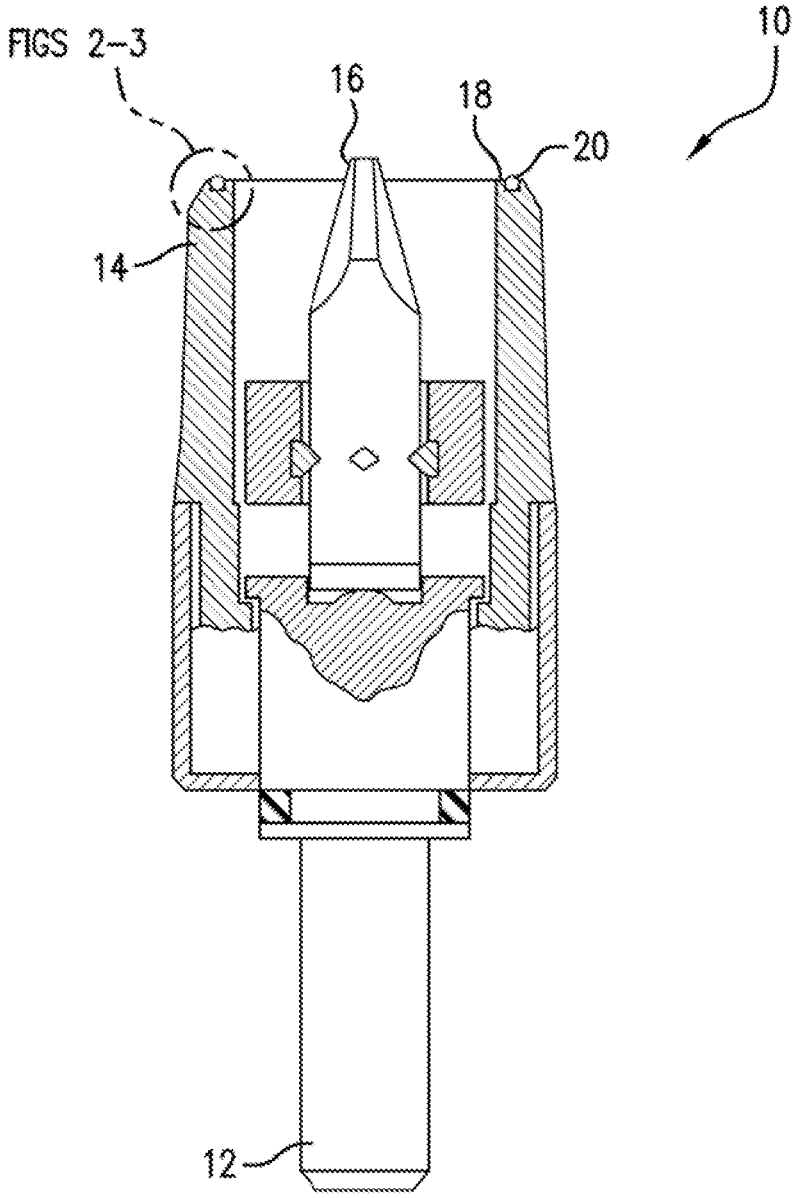
FIG. 1 is a partial cross sectional view of a depth setter as an attachment for a rotary tool for one embodiment of the present invention.

With reference to FIG. 1, there is shown for one embodiment of the present invention a depth setter identified generally by reference numeral 10. The depth setter 10 includes a shaft 12 which is secured to the draft mechanism of a rotary tool (e.g., power tool, handheld or otherwise), a cylindrical shell or collar 14 operatively engaged to the shaft 12, and a bit tip 16 in the form of a screwdriver head. In the embodiment shown in FIG. 1, the bit tip 16 is designed to fit onto the head of a screw. In alternate embodiments, the bit tip can also be any other bit tip such as a drill bit, etc. The shaft 12 may be inserted into a gripping device, such as a collet or chuck. The collar 14 is configured to rotate independently from the shaft 12, and may further include a clutch mechanism therebetween to allow the driving force of the rotary tool to be interrupted when contact is made with the surface of the workpiece.

The collar 14 includes an edge portion 18 extending therealong around the bit tip 16. The edge portion 18 is configured for engagement with the workpiece surface when a predetermined depth is reached during operation. Because the collar 14 rotates essentially independently of the shaft 12, it will cease rotating upon minimal driving frictional contact with the workpiece and therefore at least substantially avoids marring of the workpiece. The edge portion 18 includes a rubber O-ring 20 seated within a groove 22 (see FIGS. 2 and 3) extending along the length thereof. The rubber O-ring 20 prevents marring of the workpiece surface. The rubber O-ring 20 increases the coefficient of friction between the collar edge portion 18 and the workpiece surface to ensure that the collar 14 stops rotating as soon as it contacts the surface of the workpiece, thus further minimizing any marring or damage.

Figure 2:
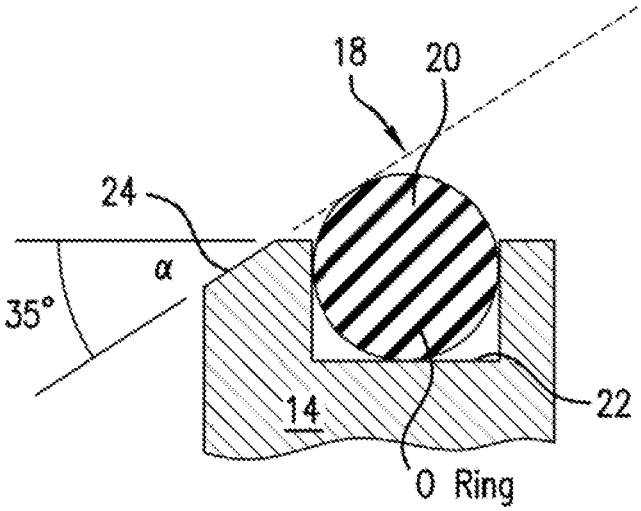
FIG. 2 is an enlarged cross sectional view of the circled area marked FIGS. 2-3 shown in FIG. 1 for one embodiment of the present invention.
Figure 3:
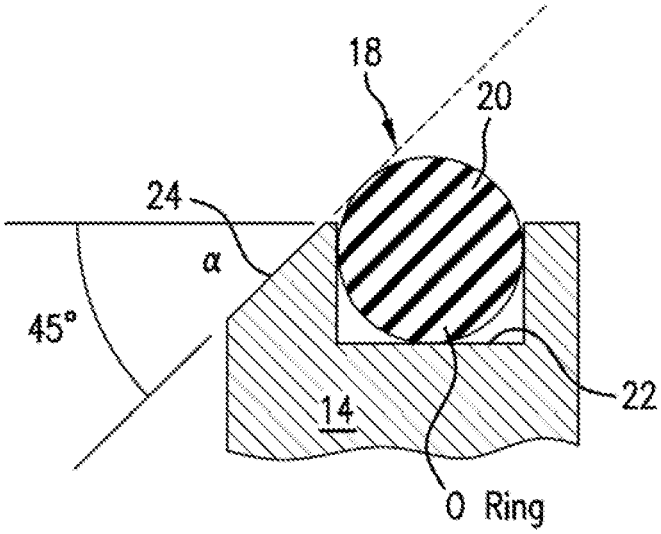
FIG. 3 is an enlarged cross sectional view of the circled area marked FIGS. 2-3 shown in FIG. 1 for a second embodiment of the present invention.

Referring to FIGS. 2 and 3, the specific dimensions shown are merely those relating to one particular embodiment and are not limiting of the scope of the invention as claimed. The edge portion of the collar 14 further includes a truncated surface 24 extending therealong on the exterior side proximate the O-ring 20. The truncated surface 24 forms an outside beveled or chamfered edge that is offset at an angle, $\alpha$, from the plane of the edge portion 18. This angle, $\alpha$, is less than 90°, and preferably from about 35° to about 45°. The truncated surface 24 allows the user to screw into the workpiece surface at less than 90° (i.e., offset at an angle) and avoid denting of the material with the edge portion 18 of the collar 14.

Figure 4:
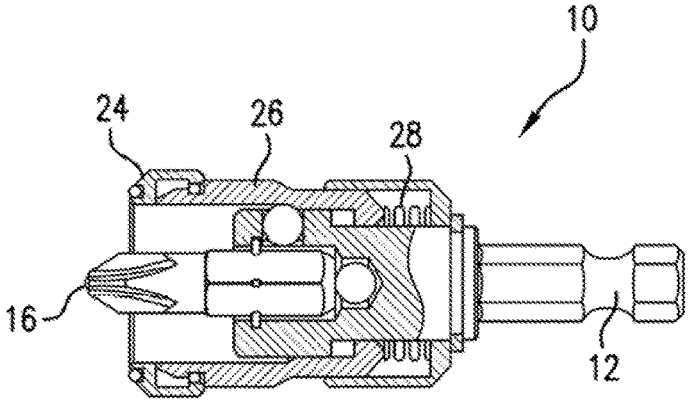
FIG. 4 is a partial cross sectional view of a depth setter as an attachment for a rotary tool for another embodiment of the present invention having a fixed depth setting.

Referring to FIG. 4, the depth setter shown is one in which the depth setting member 26 is a unitary piece and therefore results in a fixed depth setting for this embodiment. Resilient force applying member 28 shown in FIG. 4, is an optional element and resists movement of depth setting member 26 until force is applied to it by contact with the workpiece surface.

Figure 5:
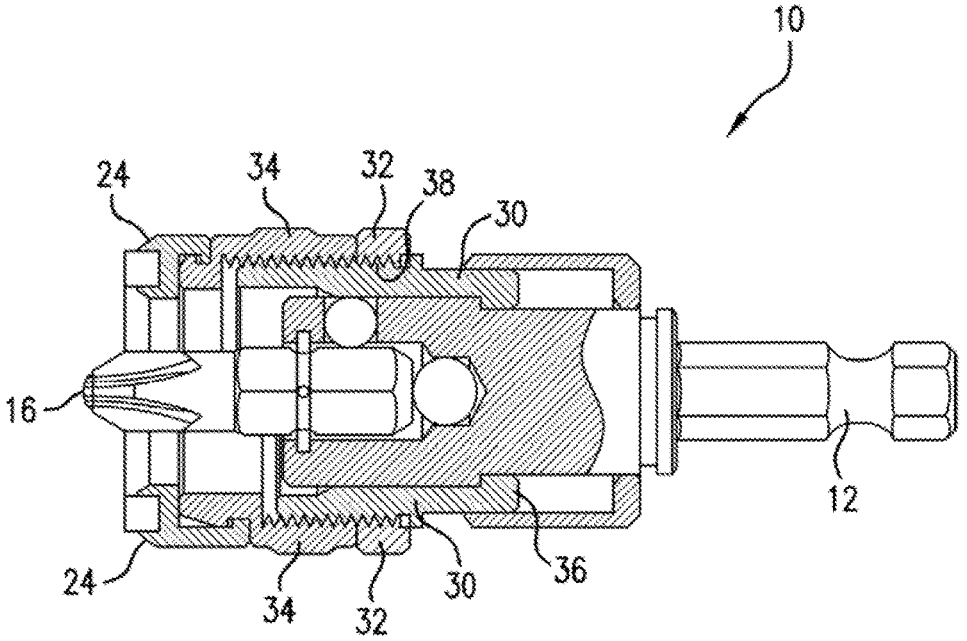
FIG. 5 is a partial cross sectional view of a depth setter as an attachment for a rotary tool for still another embodiment of the present invention having an adjustable depth setting.

Referring to FIG. 5, the depth setter shown is similar to that shown in FIG. 4 except that depth setting member 26 of FIG. 4 is replaced by an adjustable depth setting mechanism 28, which comprises elements 30, 32, and 34. Element 30 has an upper end 36 and an outer peripherally threaded area 38. Elements 34 and 32 each have internally threaded areas for engaging with the outer peripherally threaded area 38. In a first position, element 32 is fully threaded onto element 30 and then element 34 is fully threaded onto element 30 to result in the largest depth setting possible. When a smaller depth setting is desired, elements 32 and 34 are either not threaded onto element 30 fully, or if already threaded onto element 30 to yield a larger depth setting than desired, element 34 is backed off a sufficient amount and then element 32 is similarly backed off to lock element 34 in place.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

I claim:

1. A depth setter for a rotary tool, which includes:

a distal end having a centrally-located bit tip and a cylindrical collar having a surface for contacting a workpiece when in use with an edge portion extending therearound;

said edge portion including a resilient elastomeric material extending therealong and a truncated surface extending peripherally therearound, said truncated surface resulting in a lesser surface contact with said workpiece than would be present in the absence of said surface being truncated; and an attachment end for securely attaching the depth setter to the drive mechanism of said rotary tool.

2. The depth setter of claim 1 having a fixed depth setting.

3. The depth setter of claim 1 having an adjustable depth setting.

4. A kit comprising the depth setter of claim 1 in conjunction with packaging and labeling therefor.

5. A method for construction or repair of a workpiece which requires at least one operation of drilling said workpiece and of installing screws in said workpiece, comprising performing at least one operation of said drilling of said workpiece and said installing said screws in said workpiece and utilizing the depth setter of claim 1 in the course of performing at least one of said at least one operation.

* * * * *